US008731382B2

(12) United States Patent
Schultz et al.

(10) Patent No.: US 8,731,382 B2
(45) Date of Patent: May 20, 2014

(54) STEAM GENERATOR

(75) Inventors: Roger L. Schultz, Ninnekah, OK (US); Robert L. Pipkin, Marlow, OK (US); Travis W. Cavender, Angleton, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 974 days.

(21) Appl. No.: 12/687,655

(22) Filed: Jan. 14, 2010

(65) Prior Publication Data

US 2011/0170844 A1 Jul. 14, 2011

(51) Int. Cl.
*H05B 3/60* (2006.01)

(52) U.S. Cl.
USPC ..... 392/311; 392/324; 392/303

(58) Field of Classification Search
None
See application file for complete search history.

(56) References Cited

U.S. PATENT DOCUMENTS

| | | | | |
|---|---|---|---|---|
| 3,688,077 | A | 8/1972 | Williams | |
| 4,052,586 | A | 10/1977 | Brunner | |
| 4,292,498 | A | 9/1981 | Rouf | |
| 4,369,351 | A * | 1/1983 | Massey et al. | 392/312 |
| 4,694,907 | A | 9/1987 | Stahl et al. | |
| 5,623,576 | A | 4/1997 | Deans | |
| 7,717,167 | B2 | 5/2010 | Storm et al. | |
| 2010/0071900 | A1 | 3/2010 | Cavender et al. | |

FOREIGN PATENT DOCUMENTS

SU 891160 A1 12/1981

OTHER PUBLICATIONS

Foreign communication from a related counterpart application—International Search Report and Written Opinion, PCT/US2010/059658, Dec. 5, 2011, 13 pages.

* cited by examiner

*Primary Examiner* — Thor Campbell
(74) *Attorney, Agent, or Firm* — Craig Roddy; Conley Rose, P.C.

(57) ABSTRACT

A method of generating steam by moving at least a portion of an electrically conductive fluid body along a curved path, passing an electrical current through at least a portion of the fluid body that is moving along the curved path, and vaporizing at least a portion of the fluid body. A steam generating apparatus having a first hydrocyclone configured to promote a rotational kinetic characteristic of a fluid body introduced into the first hydrocyclone and a plurality of electrodes configured to deliver an electrical current to the fluid body. A method of servicing a wellbore by providing a fluid body with rotational kinetic characteristics, passing an electrical current through the fluid body to heat the fluid body, converting liquid of the fluid body to vapor, and delivering the vapor to the wellbore.

20 Claims, 7 Drawing Sheets

STEAM GENERATOR

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

This invention relates wellbore servicing tools.

BACKGROUND OF THE INVENTION

Some wellbore servicing tools and methods use steam. Accordingly, steam generation for use with such tools and methods is an important component of servicing some wellbores. Some methods of generating steam are prone to premature failure of steam generation components and/or provide inadequate steam quality. For example, some steam generation systems produce steam primarily by conducting heat from resistive electrical heating elements to water. In some cases, the water is separated from the conduction surface which decreases heat transfer from the heating elements to the water and damages the heating elements due to overheating. Such separation of the water from the conduction surface may occur due to impurities in the water building up on the conduction surface of the heating elements and/or volumes of less conductive superheated vapor quickly forming between the conduction surface and the water. In other cases where water is heated by passing an electrical current through the water, steam generation may be inhibited when a conductive path of the water is decreased in response to the formation of vapor within the liquid water which results in an increasingly vapor laden mixed-phase fluid. As the concentration of vapor within the liquid increases, the conductive path of the mixed-phase fluid is lessened so that less electrical current may pass therethrough at a substantially constant voltage. In other words, as an increasing portion of the mixed-phase fluid is converted to steam, the mixed-phase fluid is decreasingly capable of producing additional steam.

SUMMARY OF THE INVENTION

Disclosed herein is a method of generating steam, comprising moving at least a portion of an electrically conductive fluid body along a curved path, passing an electrical current through at least a portion of the fluid body that is moving along the curved path, and vaporizing at least a portion of the fluid body.

Further disclosed herein is a steam generating apparatus, comprising a first hydrocyclone configured to promote a rotational kinetic characteristic of a fluid body introduced into the first hydrocyclone, and a plurality of electrodes configured to deliver an electrical current to the fluid body.

Also disclosed herein is a method of servicing a wellbore, comprising providing a fluid body with rotational kinetic characteristics, passing an electrical current through the fluid body to heat the fluid body, converting liquid of the fluid body to vapor, and delivering the vapor to the wellbore.

DETAILED DESCRIPTION OF THE PREFERRED EMBODIMENTS

Figure 1:
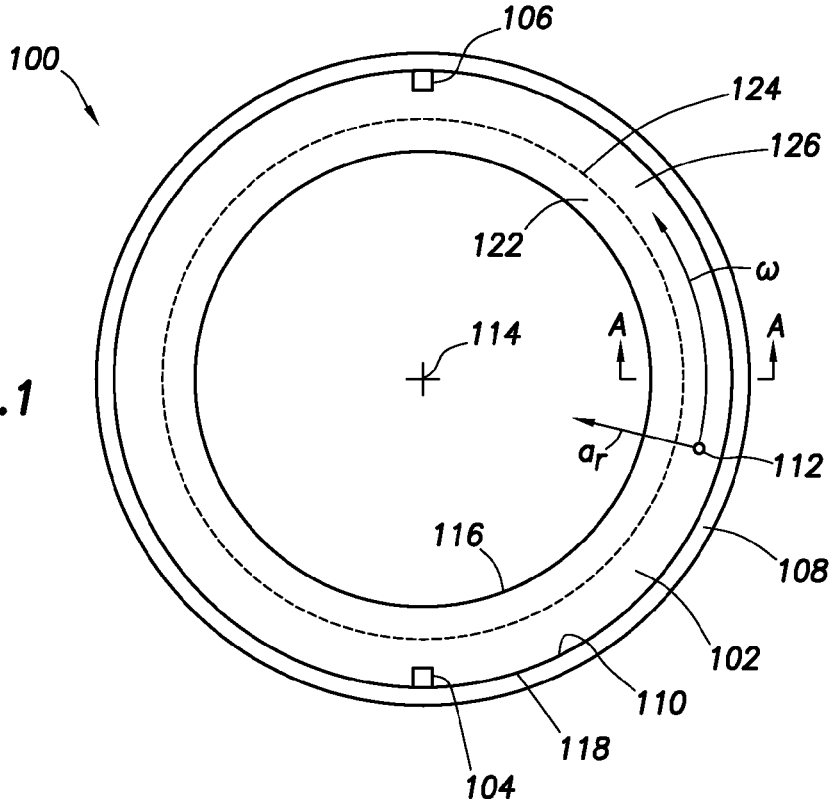
FIG. 1 is an orthogonal schematic top view of a steam generation system according to an embodiment of the disclosure.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation.

It will be appreciated that when the term "water" is used in this disclosure, the term may be used to described substantially pure water, water comprising soluble components such as sodium, and/or may be used to refer to any other fluid and/or mixture comprising water as a primary component thereof. Further, it will be appreciated that the electrical conductivity of water, fluids, and mixtures may be a function of components dissolved and/or suspended therein.

The various characteristics mentioned above, as well as other features and characteristics described in more detail below, will be readily apparent to those skilled in the art with the aid of this disclosure upon reading the following detailed description of the embodiments, and by referring to the accompanying drawings.

FIG. 1 is an orthogonal schematic top view of a steam generation system 100. Steam generation system 100 comprises a fluid body 102 which serves as an electrical conduction path between electrodes 104, 106. At least a portion of the fluid body 102 moves along a non-linear path, in this case, generally within a cylinder 108 along inner cylinder surface 110. At least partially due to the movement of some of the fluid body 102 along the non-linear path, at least a portion of the fluid body 102, represented schematically by representative finite portion of the fluid body 102 such as a fluid volume and/or particle 112, comprises a radial acceleration, $a_r$, directed toward the center of curvature of the non-linear path, represented as axis 114. In this embodiment, the entire fluid body 102 may be conceptualized as moving substantially uniformly about the axis 114 to form a substantially tube-like layer of fluid in contact with the inner cylinder surface 110. Of course, as the fluid body 102 generally revolves about the axis 114, the fluid body 102 and/or individual volumes and/or particles of the fluid body 102 may be described as comprising an angular velocity, ω, about the axis 114. The fluid body 102 may further be characterized as comprising a radial inner boundary 116 and a radial outer boundary 118 that generally abuts inner cylinder surface 110.

To simplify the explanation of this embodiment of the disclosure, it will be appreciated that the fluid body 102, either entirely or portions thereof, may be imparted with the above-described radial acceleration and angular velocity via any suitable devices and/or methods and that the device and/or methods used to impart such movement should not be interpreted as limiting in scope. For example, the fluid of the fluid body 102 may comprise rotational kinetic characteristics prior to being introduced into the cylinder 108. Alternatively and/or additionally, the entire cylinder 108 may be rotated about axis 114 in a manner that results in the fluid body 102 comprising rotational kinetic characteristics. In other words, the rotational kinetic characteristics of the fluid body 102 may be accomplished by introducing the fluid body 102 into the cylinder 108 with such rotational kinetic characteristics upon introduction and/or the kinetic characteristics may be imparted, maintained, and/or otherwise altered after introduction into the cylinder 108. For example, in some embodiments, the cylinder 108 may be part of a centrifuge or other rotating device configured to spin the fluid body 102. Regardless the manner in which the fluid body 102 is provided the above-described rotational kinetic characteristics, it will be appreciated an electrical current is flowed through the fluid body 102 while at least a portion of the fluid body 102 comprises the above-described rotational kinetic characteristics. Put another way, electrical current may be passed through the fluid body 102 while at least a portion of the fluid body 102 moves along the curved path.

Figure 2:
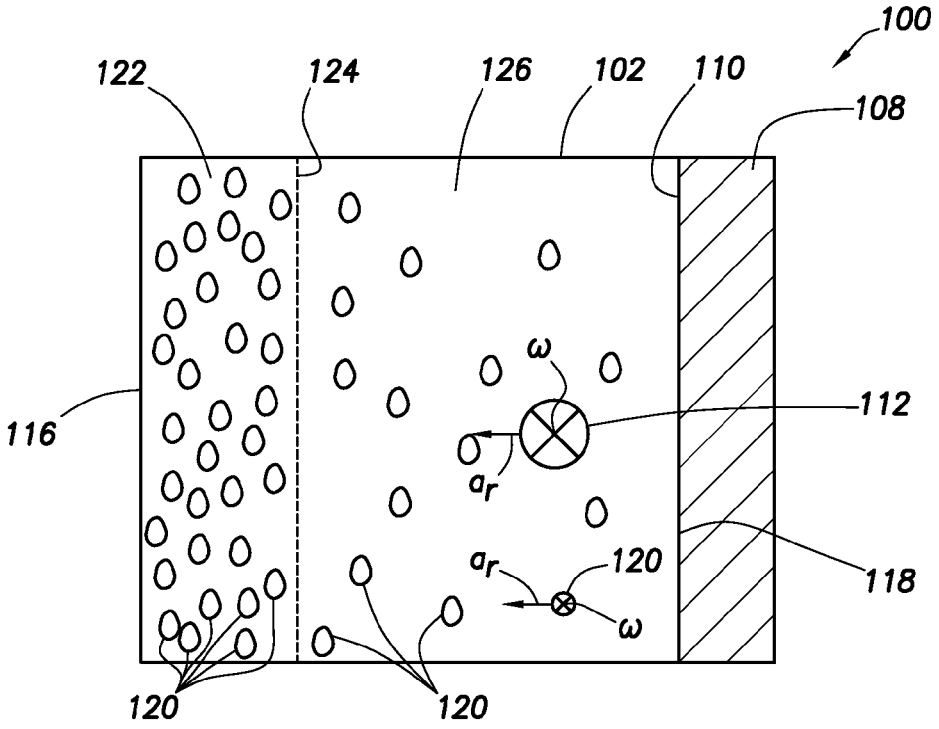
FIG. 2 is a partial cross-sectional view of the steam generation system of FIG. 1 taken along cutting plane A-A of FIG. 1.

In some embodiments, the fluid body 102 may initially be a substantially single phase fluid mixture comprising primarily liquid water. After the fluid body 102 has been imparted a generally rotational kinetic characteristic, an electrical current may be passed or may continue to be passed through the primarily liquid fluid body 102. As the electrical current is passed through the fluid body 102, the fluid body 102 may perform the function of an electrical resistor, generating heat in response. As the fluid body 102 is heated, some portions of the fluid body 102 may convert from liquid phase to vapor phase. The water that that is converted to vapor phase is steam. The steam may be generated anywhere within the fluid body 102 and therefore may take the form of vapor pockets 120 surrounded by otherwise liquid water, as shown in FIG. 2. With sufficient steam production and sufficient deposition of vapor pockets 120 within the liquid of the fluid body 102, an electrical conductivity of the fluid body 102 may be decreased and/or otherwise compromised as a result of a cross-sectional area of the liquid conduction path comprising an increased area of the less conductive vapor. It will be appreciated that a function of providing the fluid body 102 with rotational kinetic characteristics is that the rotation of the fluid body 102 about the center of curvature tends to promote retention of the electrical conductivity of the fluid body 102 by separating the vapor pockets 120 (steam) from the liquid water.

Referring now to FIG. 2, a partial cross-sectional view taken at cutting line A-A of FIG. 1 is provided to show the fluid body 102 and cylinder 108 in greater detail. As the rotating fluid body 102 is heated due to the electrical current passing therethrough, vapor pockets 120 may form anywhere within the depicted cross-sectional area of the mixed-phase fluid body 102. However, due to the rotational kinetic characteristics of the fluid body 102, the less dense vapor pockets 120 are forced centrally inward toward the axis 114 by the denser fluid of the fluid body 102 in a centrifuge-like action. In some embodiments, the vapor pockets 120 may be forced out of the fluid body 102 at a rate relative to a rate of vapor pocket 120 formation so that a buildup of vapor pockets 120 sufficient to reduce electrical conductivity is substantially prevented, allowing the entire fluid body 102 to remain electrically conductive despite the production of steam. However, in other embodiments, the concentration of vapor pockets 120 may be so great near the inner boundary 116 of the fluid body 102 that an electrically non-conducive zone 122 may be formed. The depiction of the electrically non-conductive zone 122 is greatly simplified for purposes of clarity of discussion and it will be appreciated that any such non-conductive zone 122 may be irregularly shaped about the center of curvature and in radial thickness.

It will be appreciated that the fluid body 102 may be caused to comprise portions of electrical non-conductivity and/or portions of significantly increased electrical resistance as a result of the spatial congregation of vapor pockets 120. In this embodiment, the non-conductive zone 122 is generally bound by the inner boundary 116 and the so-called conductivity boundary 124. It will be appreciated that rotating the fluid body 102 at greater angular velocities may increase the cross-sectional area of a conductive zone 126 while decreasing a cross-sectional area of the non-conductive zone 122. For example, an increase in angular velocity of the fluid body 102 may cause faster migration of the vapor pockets 120 toward the center of curvature, resulting in the conductivity boundary 124 being located nearer the center of curvature or resulting in the non-conductive zone 122 being eliminated altogether. It will be appreciated that this disclosure specifically contemplates many different systems and methods for passing electrical current through the conductive portions of the fluid body 102 as the fluid body 102 is provided with rotational kinetic characteristics to promote separation of vapor from liquid components of the fluid body 102. Further, it will be appreciated that steam may be continuously generated despite the generation of vapor pockets 120 so long as conductive zone 126 is maintained in a manner that provides a continuous conductive path between electrodes 104, 106.

Figure 3:
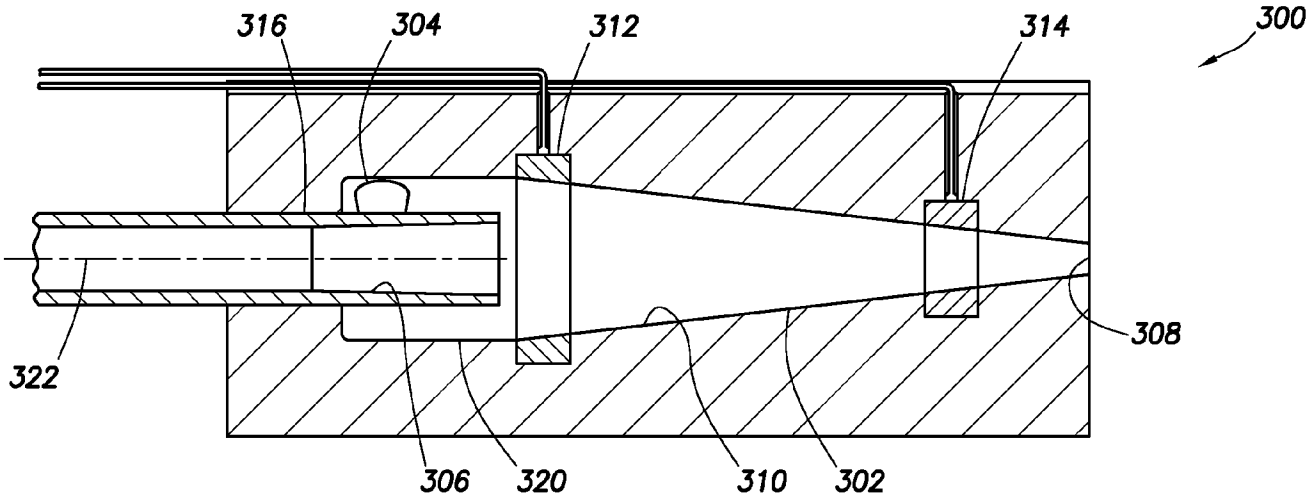
FIG. 3 is a cut-away simplified schematic view of a downhole steam generation tool according to an embodiment of the disclosure.
Figure 4:
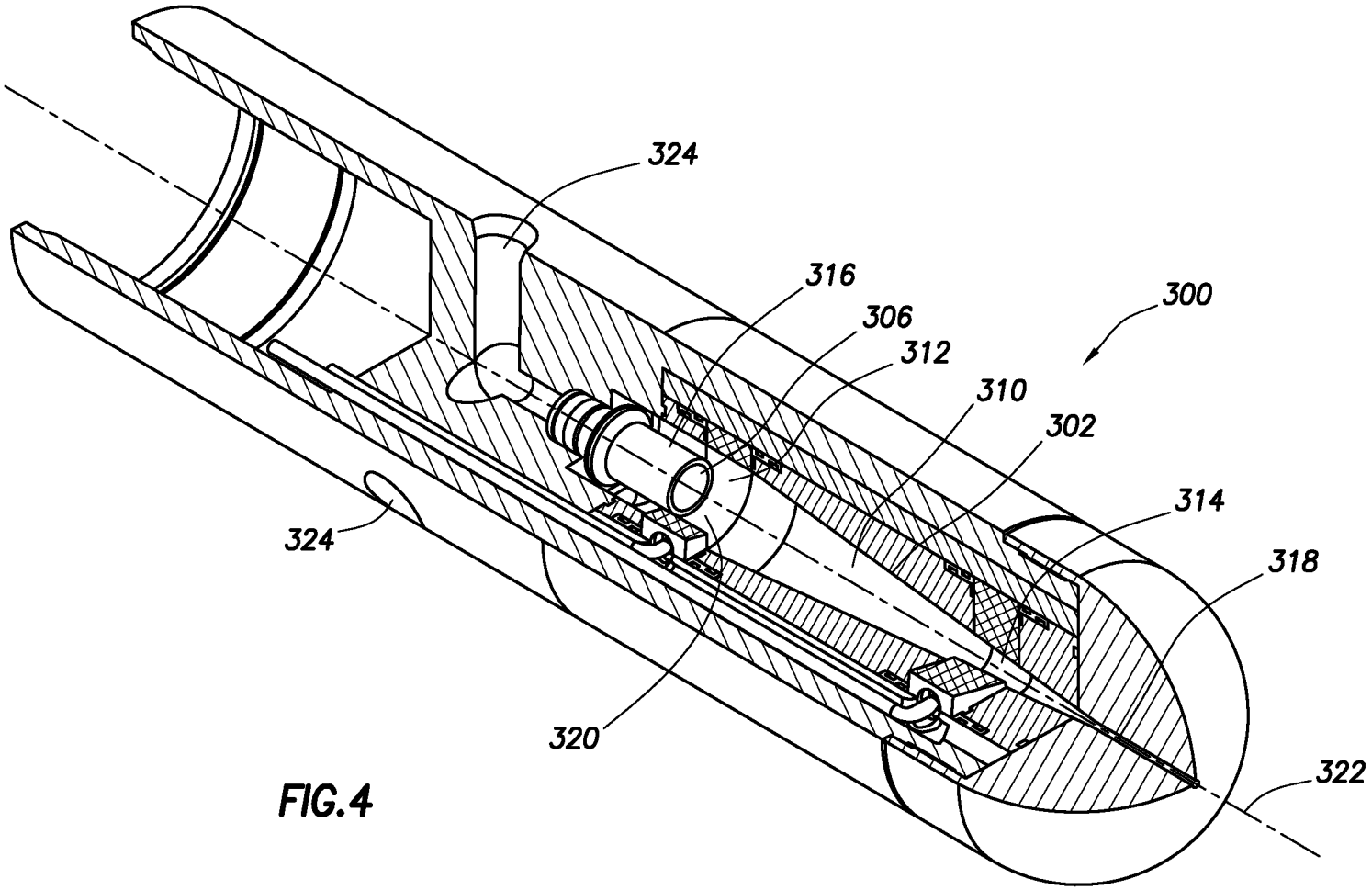
FIG. 4 is a more complex cut-away view of the downhole steam generation tool of FIG. 3.

Referring now to FIGS. 3 and 4, a downhole steam generation tool 300 is shown. FIG. 3 shows a cut-away simplified schematic view of the downhole steam generation tool 300 while FIG. 4 shows a more complex cut-away view of the downhole steam generation tool 300. Tool 300 generally comprises a hydrocyclone 302 comprising an inlet 304, an overflow exit 306, and an underflow exit 308. The hydrocyclone 302 comprises a substantially frusto-conical inner surface 310 that is at least partially formed by an upper ring electrode 312 and a lower ring electrode 314. In some embodiments, an upper exit tube 316 may at least partially define the overflow exit 306. In some embodiments, a lower exit tube 318 may at least partially define the underflow exit 308. Water or any other potentially electrically conductive fluid and/or fluid mixture may be introduced into the hydrocyclone 302 through the inlet 304. The inlet 304 is generally oriented to provide a substantially tangential entry path into an upper cylindrical zone 320 of the hydrocyclone 302 formed adjacent the frusto-conical portion of the inner surface 310. In FIG. 4, the inlet 304 is obscured from view by the upper exit tube 316.

Operation of the downhole steam generation tool 300 may be initiated by providing a flow of potentially conductive fluid into the hydrocyclone 302 through the inlet 304. Due to the tangential orientation of the inlet 304 with respect to the cylindrical zone 320 of the hydrocyclone 302, the fluid is imparted with a rotational kinetic characteristic so that the fluid moves about an axis 322. The fluid may then travel downward through the hydrocyclone 302 in a generally spiraling motion so that the fluid forms a fluid body 102 extending substantially the entire length of the hydrocyclone 302. With the fluid body 102 spinning against the frusto-conical portion of the inner surface 310, the fluid body 102 contacts both the upper ring electrode 312 and the lower ring electrode 314, forming an electrical connection between the upper ring electrode 312 and the lower ring electrode 314. Electricity may be applied to the upper ring electrode 312 and the lower ring electrode 314 to provide an electrical potential difference between the two electrodes 312, 314. With such electricity applied to the electrodes 312, 314, electrical current may pass between the electrodes 312, 314 through the fluid body 102 that joins the electrodes 312, 314. As explained above with regard to the steam generation system 100, passing electrical current through the fluid body may generate heat sufficient to convert liquid of the fluid body 102 to vapor.

In a manner similar to the manner described above with regard to the steam generation system 100, vapor may be separated from the liquid of the fluid body 102 in the hydrocyclone 302. As the vapor is separated from the liquid, the vapor may move radially inward toward the axis 322 and be forced out the overflow exit 306 through the upper exit tube 316. In some embodiments, fluid that is not forced out of the overflow exit 306 may be forced to exit the hydrocyclone 302 through the underflow exit 308. In cases where significant amounts of liquid are converted to vapor as the fluid body 102 travels downward along the frusto-conical portion of the inner surface 310 of the hydrocyclone 302, the conductive zone 126 of the fluid body 102 may be reduced in cross-sectional area due to a loss of fluid mass within the hydrocyclone 302. With such a reduction in cross-sectional area of the conductive zone 126, it becomes increasingly important to ensure separation of the vapor from the remaining liquid of the fluid body 102. It will be appreciated that the fluid flow principles of the hydrocyclone 302 generally operate to employ conservation of angular momentum so that the fluid particles experience an increase in angular velocity as they travel toward the underflow exit 308. Accordingly, by increasing the angular velocity of the fluid particles of the fluid body 102 as the particles move downward through the hydrocyclone 302, the cross-sectional area of the conductive zone 126 is improved for conducting the above-described electrical current by increasingly urging separation of the vapor from the liquid and minimizing any non-conductive zones 122 (e.g., to minimize any non-conductive zone 122). In this embodiment, the fluid body 102 must generally extend fully between the electrodes 312, 314 to provide the electrical conduction path comprising the fluid body 102.

As steam is generated and exits the hydrocyclone 302 through the upper exit tube 316, the steam may be routed into a wellbore within which the tool 300 is located. In some embodiments, the steam may be passed from the upper exit tube 316 that extends generally longitudinally along axis 322 into radial ports 324 that provide passage into the wellbore. Of course, in other embodiments the steam may be routed in any other desired manner. Further, it will be appreciated that while the above-described tool 300 is explained in the context of being for use as situated in a downhole location, the tool 300 and/or the components and/or principles of operation of the tool 300 may be implemented in locations other than downhole. For example, the tool 300 may be used to generate steam at ground level or above in substantially the same manner as described above, but with the generated steam being piped or otherwise directed downhole or to any other suitable destination.

Figure 5:
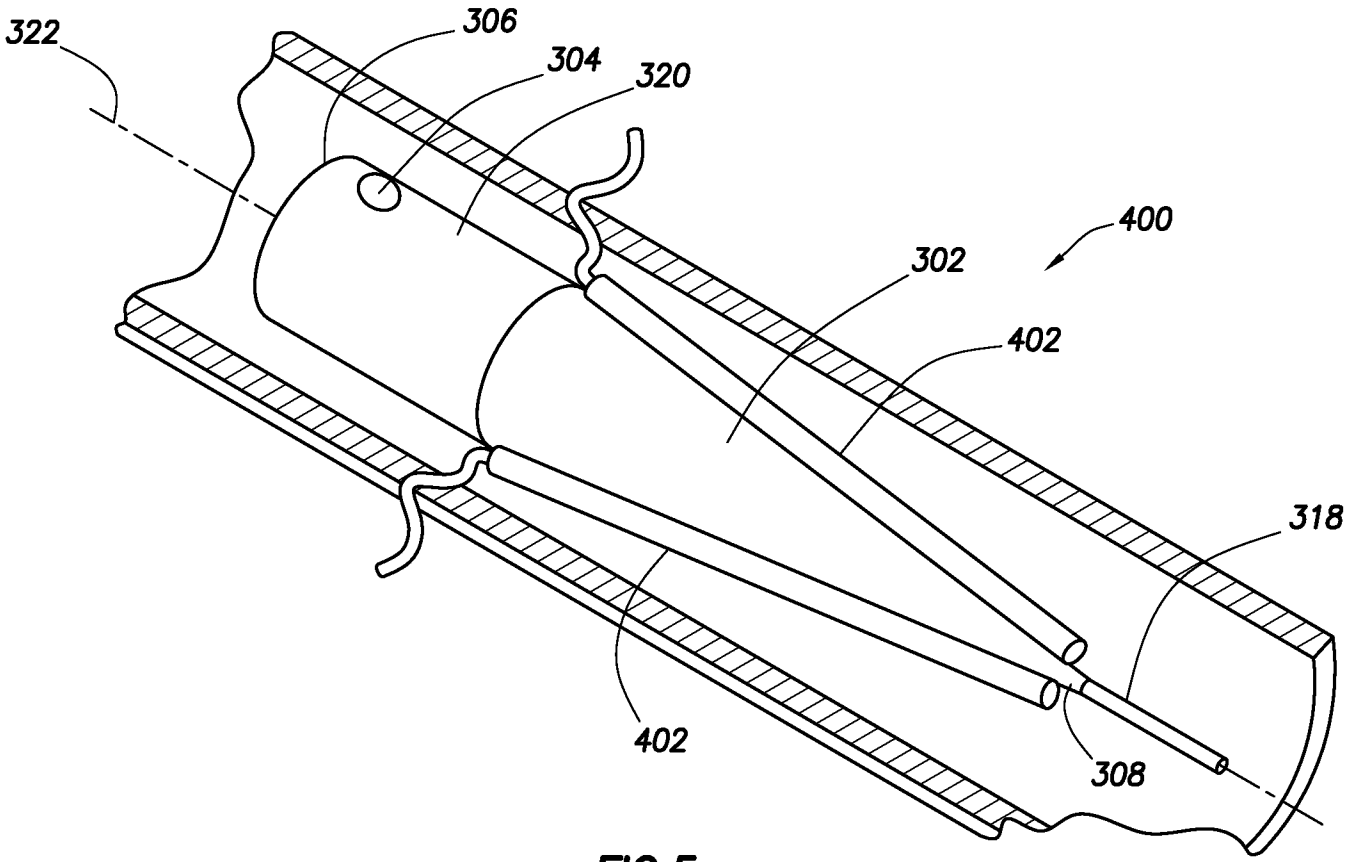
FIG. 5 is an oblique simplified schematic view of a downhole steam generation tool according to another embodiment of the disclosure.

Referring now to FIG. 5, an oblique simplified schematic view of a downhole steam generation tool 400 is shown. The tool 400 is substantially similar in form and operation to that of tool 300. However, tool 400 is provided with longitudinal electrodes 402. Longitudinal electrodes 402 each form a portion of the inner surface 310 of the hydrocyclone 302 of the tool 400. Accordingly, in order for an electrical connection to be maintained between electrodes 402, a fluid body 102 of any longitudinal length along axis 322 may provide such an electrical connection so long as the fluid body 102 sufficiently wraps angularly about the axis 322 to contact both electrodes 402. As compared to the tool 300, the tool 400 does not require any set longitudinal length of fluid body 102 within the hydrocyclone 302.

Figure 6:
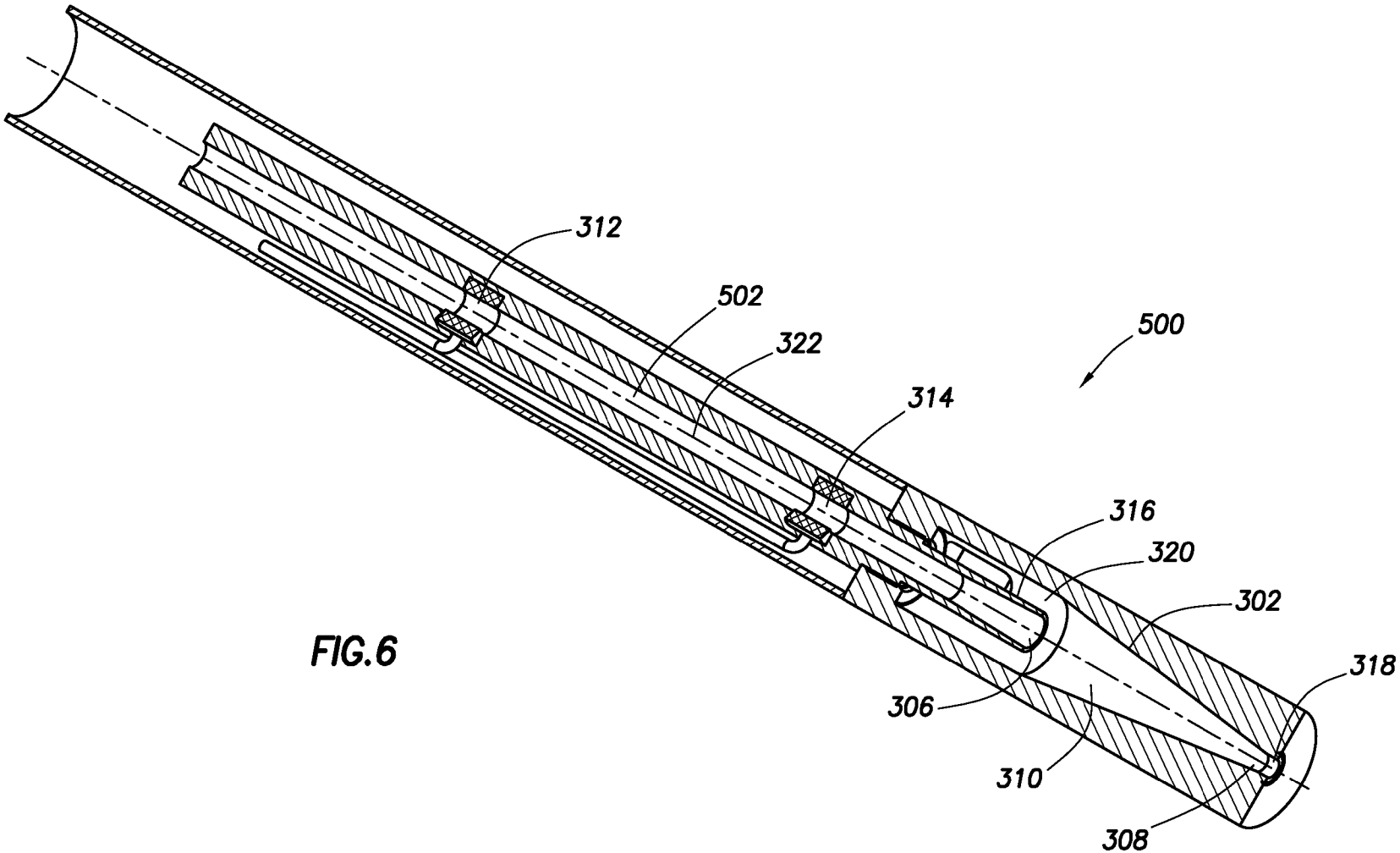
FIG. 6 is an oblique cut-away simplified schematic view of a downhole steam generation tool according to yet another embodiment of the disclosure.

Referring now to FIG. 6, an oblique cut-away simplified schematic view of a downhole steam generation tool 500 is shown. The tool 500 is substantially similar in form and operation to that of tools 300 but for the location of the upper ring electrode 312 and the lower ring electrode 314. Under some fluid flow conditions, substantial amounts of rotating and/or spinning liquid may be forced out of the hydrocyclone 302 through the upper exit tube 316. Accordingly, in some embodiments where such fluid flow conditions are anticipated or caused by design, the electrodes 312, 314 may be formed as portions of an inner surface 502 of the upper exit tube 316. In other words, the tool 500 employs the hydrocyclone 302 to impart the desired rotational kinetic characteristics to the fluid body 102 and forces liquid of the fluid body 102 out of the hydrocyclone 302 through the upper exit tube 316. During the passage of the liquid of the fluid body 102 through the upper exit tube 316, electrical current is passed through the liquid to generate steam. Because the liquid and generated steam are rotating within the upper exit tube 316, the above-described principles of separating the vapor from the liquid still apply and the generated steam may be forced radially inward toward axis 322 and out of the upper exit tube 316.

Figure 7:
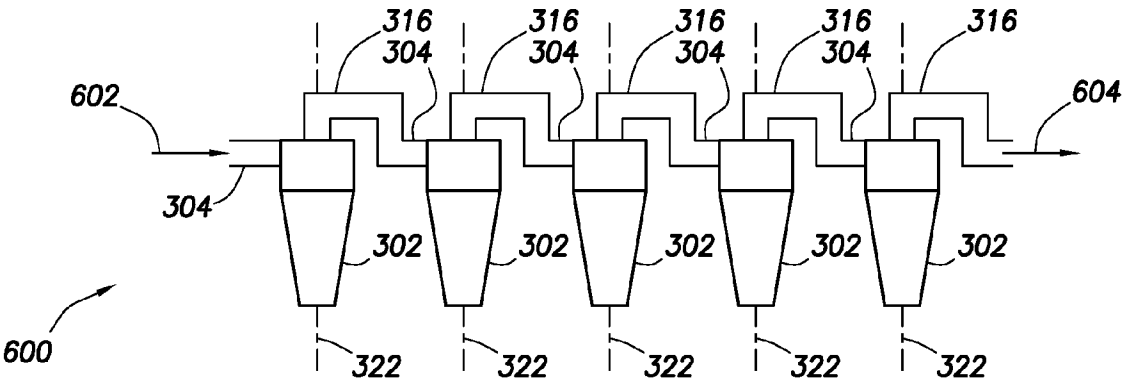
FIG. 7 is a schematic diagram of a steam generation system according to another embodiment of the disclosure.

Referring now to FIG. 7, a schematic diagram of a steam generation system 600 is shown. Steam generation system 600 comprises a plurality of individual steam generation tools such as any plurality or combination of one or more of downhole steam generation tools 300, 400, 500. The mass of liquid that may be converted to vapor by any particular one of the tools disclosed herein is a factor of, inter alia, the voltage applied to the electrodes, the conductivity of the fluid bodies, the cross-sectional area of the conductive zones, the incoming flowrate of the fluid body, and the general shape and size of the hydrocyclones. Varying volumes of liquid may exit a steam generation tool 300, 400, 500 without having been converted to steam. In order to convert the liquid exiting a steam generation tool 300, 400, 500 into steam, this disclosure contemplates routing the exiting liquid into subsequent steam generation tools. FIG. 7 shows five steam generation tools comprising hydrocyclones 302. An incoming flow of fluid 602 may enter a steam generation tool through an inlet 304. The fluid in the first steam generation tool may generate steam but not completely convert the liquid into vapor. Accordingly, the unconverted liquid may exit the tool through an upper exit tube 314 and thereafter be routed into a subsequent and/or downstream tool. FIG. 7 depicts a so-called "five stage" steam generation system that comprises five distinct steam generation tools linked together. If any liquid is not converted to vapor in the system 600, the liquid exits as exiting flow of fluid 604. In other embodiments, the excess liquid exiting an upstream tool may be passed through a lower exit tube 318 associated with an underflow exit 308 rather than through an upper exit tube 316 associated with an overflow exit 308.

Figure 8:
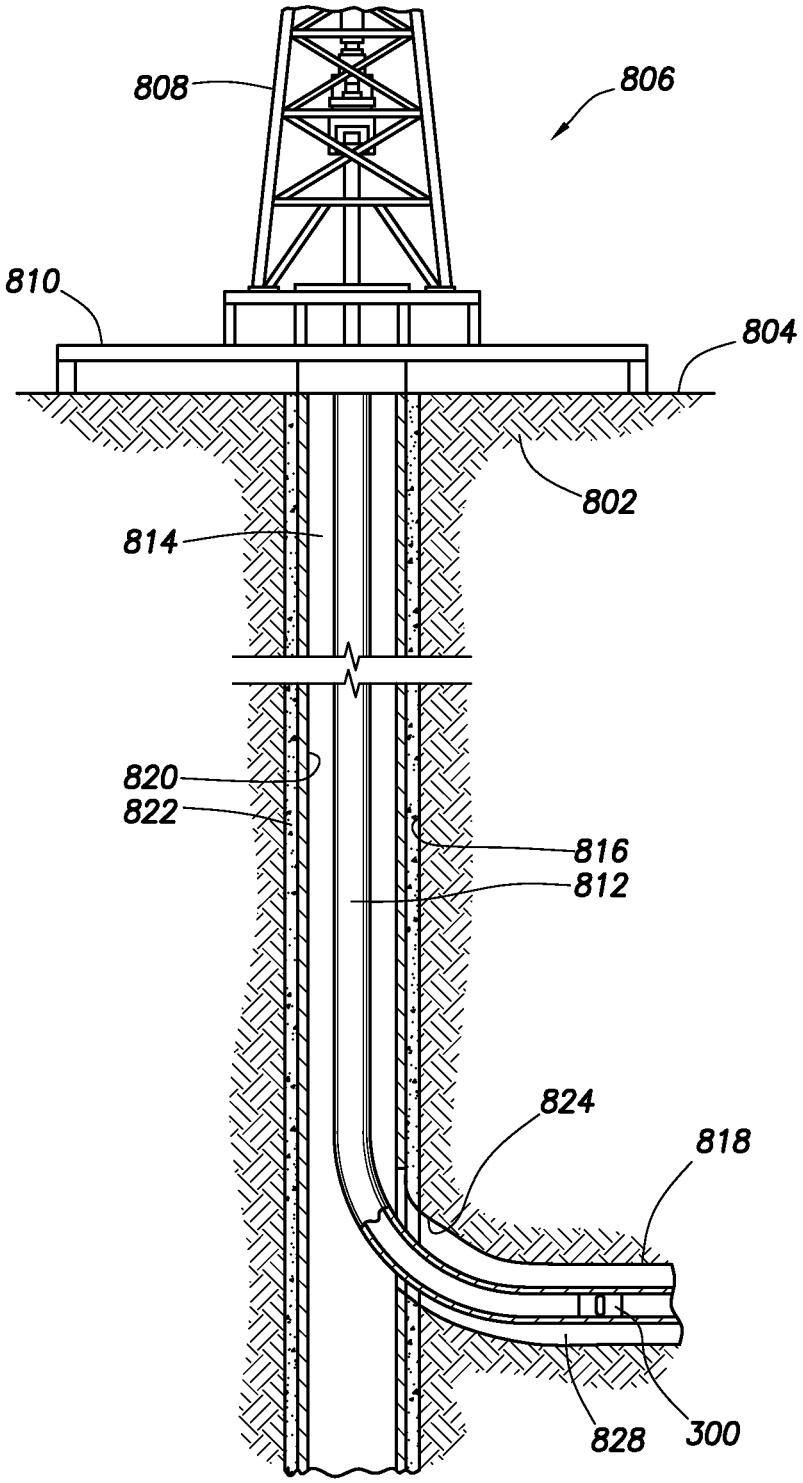
FIG. 8 shows the downhole steam generation tool of FIG. 3 in an example of an operating environment.

Referring now to FIG. 8, a downhole steam generation tool 300 is shown in an example of an operating environment. As depicted, the operating environment comprises a servicing rig 806 (e.g., a drilling, completion, servicing, or workover rig) that is positioned on the earth's surface 804 and extends over and around a wellbore 814 that penetrates a subterranean formation 802 for any purpose, e.g., recovering hydrocarbons, storing hydrocarbons, disposing of carbon dioxide, or the like. The wellbore 814 may be drilled into the subterranean formation 802 using any suitable drilling technique. The wellbore 814 extends substantially vertically away from the earth's surface 804 over a vertical wellbore portion 816, deviates from vertical relative to the earth's surface 804 over a deviated wellbore portion 824, and transitions to a horizontal wellbore portion 818. In alternative operating environments, all or portions of a wellbore may be vertical, deviated at any suitable angle, horizontal, and/or curved.

At least a portion of the vertical wellbore portion 816 is lined with a casing 820 that is secured into position against the subterranean formation 802 in a conventional manner using cement 822. In alternative operating environments, a horizontal wellbore portion may be cased and cemented and/or portions of the wellbore may be uncased. The servicing rig 806 comprises a derrick 808 with a rig floor 810 through which a tubing or work string 812 (e.g., cable, wireline, E-line, Z-line, jointed pipe, coiled tubing, casing, or liner string, etc.) extends downward from the servicing rig 806 into the wellbore 814 and defines an annulus 828 between the work string 812 and the wellbore 814. The work string 812 delivers the downhole steam generation tool 300 to a selected depth within the wellbore 814 to generate steam and deliver the steam to the subterranean formation 802. The servicing rig 806 comprises a motor driven winch and other associated equipment for extending the work string 812 into the wellbore 814 to position the downhole steam generation tool 300 at the selected depth.

While the operating environment depicted in FIG. 8 refers to a stationary servicing rig 806 for lowering and setting the downhole steam generation tool 300 within a land-based wellbore 814, in alternative embodiments, mobile workover rigs, wellbore servicing units (such as coiled tubing units), and the like may be used to lower a downhole steam generation tool into a wellbore. It should be understood that a downhole steam generation tool may alternatively be used in other operational environments, such as within an offshore wellbore operational environment.

In operation, a method of servicing the wellbore 814 may comprise delivering fluid that forms the above-described fluid body 102 to the downhole steam generation tool 300. As the fluid body 102 moves along the curved path of the hydrocyclone 302, an electrical current is passed through the fluid body 102 in the manner described above to generate steam. The generated steam is expelled from the hydrocyclone 302 through the upper exit tube 316 associated with the overflow exit 306. After the steam exits the upper exit tube 316, the steam is distributed to the annulus 828 through the radial ports 324 and ultimately to the formation 802. In alternative embodiments comprising a plurality of tools 300 located downhole, unconverted liquid fluid may be passed from an upstream tool 300 to a downstream tool 300 in a manner similarly shown in steam generation system 600.

It will be appreciated that the quality of steam generated by any of the systems 100, 600 and tools 300, 400, 500 disclosed herein may be controlled by adjusting a fluid flow rate relative to an amount of electrical power applied to the fluid. Further, while the above embodiments are described as comprising two electrodes, multi-phase electrical power may be used to generate steam by including additional electrodes. Still further, some embodiments may comprise multiple electrode pairs to increase electrical conduction. Additionally, while ring electrodes 312, 314 and longitudinal electrodes 402 are disclosed above, this disclosure further contemplates electrodes of various other shapes. For example, electrodes may be formed as spirals and/or formed to comprise undulating paths.

Figure 9:
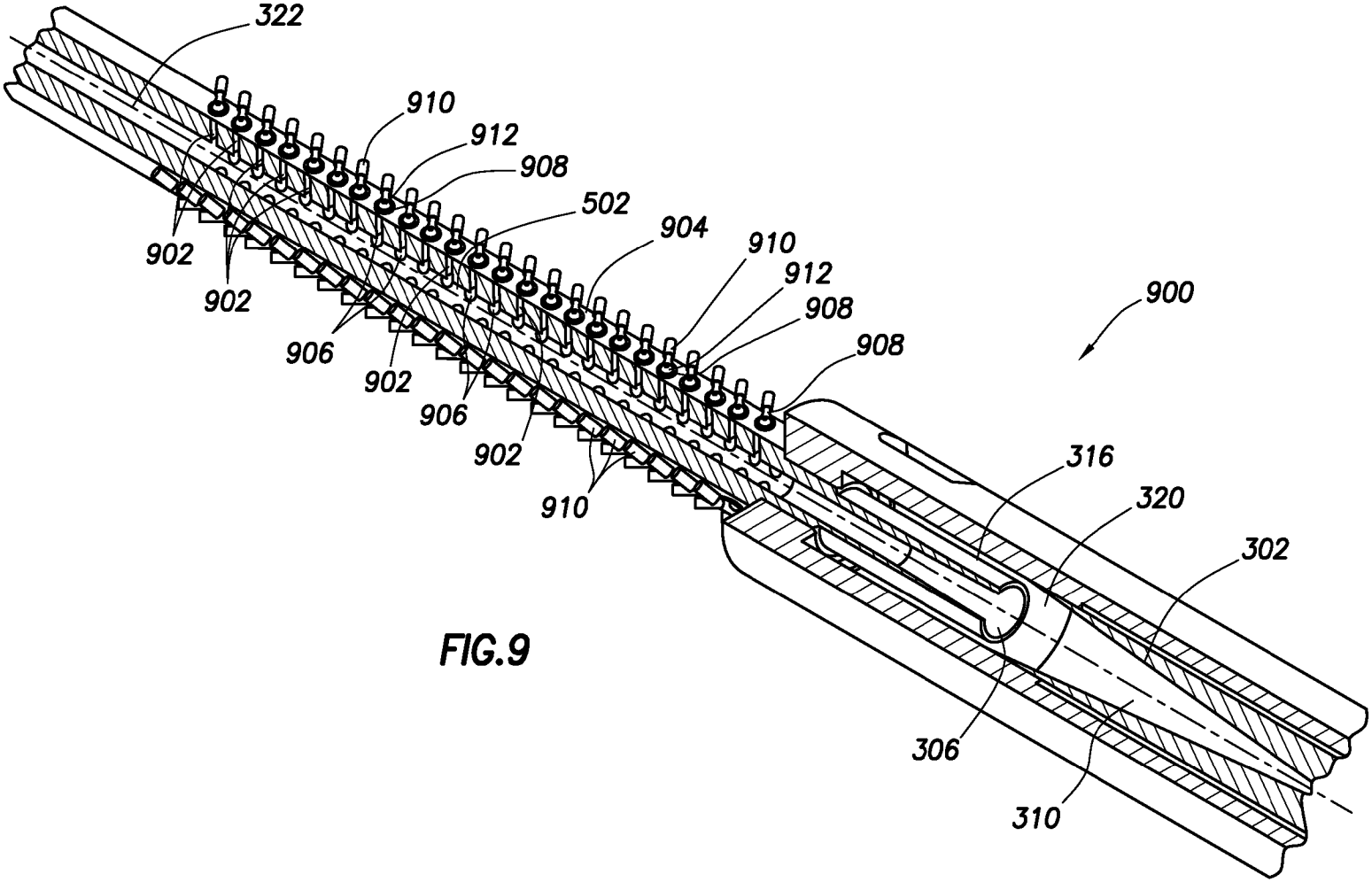
FIG. 9 is an oblique cut-away simplified schematic view of a downhole steam generation tool according to yet another embodiment of the disclosure.

Referring now to FIG. 9, an oblique cut-away simplified schematic view of a downhole steam generation tool 900 is shown. The tool 900 is substantially similar in form and operation to that of tool 500 of FIG. 6 but the tool 900 comprises a different number and arrangement of electrodes. Particularly, instead of comprising a single upper ring electrode 312 and a single lower ring electrode 314, the tool 900 comprises a plurality of radial electrodes 902. Under some fluid flow conditions, substantial amounts of rotating and/or spinning liquid may be forced out of the hydrocyclone 302 through the upper exit tube 316. Accordingly, in some embodiments where such fluid flow conditions are anticipated or caused by design, the radial electrodes 902 may be formed as portions of an inner surface 502 of the upper exit tube 316. The tool 900 may employ the hydrocyclone 302 to impart the desired rotational kinetic characteristics to the fluid body 102 and force liquid of the fluid body 102 out of the hydrocyclone 302 through the upper exit tube 316 in a manner substantially similar to that describe above with regard to tool 500.

The radial electrodes 902, in this embodiment, are generally cylindrical in form and extend generally radially relative to the axis 322 from the inner surface 502 of the upper exit tube 316 at least to an exterior surface 904 of the exit tube 316. In this embodiment, the radial electrode inner surface 906 is formed to substantially lie flush with the inner surface 502. Of course, in other embodiments, any other suitable radial electrode 902 cross-sectional shape may be provided and/or the cross-sectional shape may not be constant. Further, in other embodiments, the radial electrode inner surface 906 may extend radially inward beyond the inner surface 502 and/or be recessed radially outward from the inner surface 502. Similarly, while radial electrode outer surfaces 908 of this embodiment may generally extend to the exterior surface 904, in other embodiments, radial electrode outer surfaces 908 may extend radially inward beyond the exterior surface 904 and/or extend radially outward beyond the exterior surface 904. In this embodiment, the radial electrodes 902 may be electrically connected to electrical connectors 910 using fasteners 912. In some embodiments, the radial electrodes 902 may comprise a threaded hole for receiving a fastener 912. Of course, in other embodiments, radial electrodes 902 may be otherwise formed for connection with electrical connectors 910 and fasteners 912. Further, while in this embodiment the electrical connectors 910 and fasteners 912 may be eyelet connectors and screws, respectively, in other embodiments, any other suitable electrical connectors 910 and fasteners 912 may be used.

In this embodiment, the radial electrodes 902 are distributed relative to the upper exit tube 316 in generally longitudinal rows and adjacent rows are generally equally angularly offset about the axis 322. In this embodiment, adjacent rows of radial electrodes 902 may be provided with different electrical phases. For example, in an embodiment where the radial electrodes 902 are provided with two phases of electricity, adjacent rows of radial electrodes 902 may be provided with different ones of the two phases of electricity. Of course, where more than two phases of electricity are provided to the radial electrodes 902, the rows may be provided phases of electricity in a different distribution. Still further, in other embodiments, the distribution of different phases of electricity to the radial electrodes 902 may be provided in an alternating or other predetermined pattern irrespective of the rows in which the radial electrodes 902 are located. For example, the phases of electricity provided to the radial electrodes 902 may be provided relative to a location of the individual radial electrode 902 locations along a longitudinal length of the upper exit tube 316. Alternatively, the phases of electricity provided to the radial electrodes 902 may be provided relative to generally helical path that extends along a longitudinal length of the upper exit tube 316. Still further, in alternative embodiments, the radial electrodes 902 may be provided along such a generally helical path. It will be appreciated that the location of the radial electrodes 902 and the phases of electricity provided to the radial electrodes 902 may be provided in numerous ways and according to numerous conventions and that some conventions may be provided to minimize a length of a conductive path between radial electrodes 902. In the least, the tool 900 may provide radial electrodes 902 that are provided phases of electricity in an alternating grid to create many potential conduction paths. While the tool 900 is described above as comprising radial electrodes 902 and electrical phase distribution conventions relative to the upper exit tube 316, alternative embodiments may similarly incorporate radial electrodes 902 and/or electrical phase distribution conventions into the hydrocyclone 302, the cylindrical zone 320, and/or any other portion of a tool 900.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. The discussion of a reference in the disclosure is not an admission that it is prior art, especially any reference that has a publication date after the priority date of this application. The disclosure of all patents, patent applications, and publications cited in the disclosure are hereby incorporated by reference in their entireties.

What we claim as our invention is:

1. A method of generating steam, comprising:

moving at least a portion of an electrically conductive fluid body along a curved path formed between two electrodes, wherein each of the two electrodes forms part of an inner surface of a hydrocyclone, wherein the inner surface comprises a conical portion;

passing an electrical current through at least a portion of the fluid body that is moving along the curved path; and vaporizing at least a portion of the fluid body while moving along the inner surface of the hydrocyclone.

2. The method of claim 1, further comprising:

changing a radial acceleration of at least a portion of the fluid body, the changing of the radial acceleration promoting separation of a vapor portion of the fluid body from a liquid portion of the fluid body.

3. The method of claim 2, wherein an increase in the radial acceleration causes the vapor portion to move radially inward toward a center of curvature of the curved path.

4. The method of claim 1, further comprising:

changing an angular velocity of at least a portion of the fluid body, the changing of the angular velocity promoting separation of a vapor portion of the fluid body from a liquid portion of the fluid body.

5. The method of claim 4, wherein an increase in the angular velocity causes the vapor portion to move radially inward toward a center of curvature of the curved path.

6. The method of claim 1, further comprising:

increasing each of a radial acceleration and an angular velocity of at least a portion of the fluid body, the increasing of the radial acceleration and the angular velocity promoting separation of a vapor portion of the fluid body from a liquid portion of the fluid body.

7. The method of claim 1, wherein the inner surface of the hydrocyclone further comprises a cylindrical zone.

8. The method of claim 1, wherein a vaporized portion of the fluid body comprises steam, the method further comprising:

placing the hydrocyclone into a wellbore prior to the step of moving; and delivering steam to a subterranean formation penetrated by the wellbore.

9. A steam generating apparatus, comprising:

a first hydrocyclone configured to promote a rotational kinetic characteristic of a fluid body introduced into the first hydrocyclone, wherein the first hydrocyclone comprises an inner surface, wherein the inner surface comprises a conical portion; and a plurality of electrodes configured to deliver an electrical current to the fluid body, wherein at least two of the plurality of electrodes extend around the first hydrocyclone to form a portion of the inner surface or along a length of the first hydrocyclone to form a portion of the inner surface.

10. The steam generating apparatus of claim 9, the first hydrocyclone comprising:

an upper exit tube associated with an overflow exit of the first hydrocyclone;

wherein at least one of the plurality of electrodes forms at least a portion of an inner surface of the upper exit tube.

11. The steam generating apparatus of claim 9, further comprising:

an upper exit tube associated with an overflow exit of the first hydrocyclone; and a radial port in fluid communication with the upper exit tube for allowing steam to exit the steam generating apparatus.

12. The steam generating apparatus of claim 9, further comprising:

a second hydrocyclone configured to accept liquid from the first hydrocyclone.

13. The steam generating apparatus of claim 9, further comprising a work string coupled to the first hydrocyclone, wherein the work string and first hydrocyclone are present within a wellbore.

14. A method of servicing a wellbore, comprising:

providing a fluid body with rotational kinetic characteristics;

passing an electrical current through the fluid body to heat the fluid body and convert at least a portion of a liquid in the fluid body to vapor; and delivering at least a portion of the vapor to the wellbore;

wherein the step of passing is performed while the fluid body moves along a conical portion of an inner surface of a downhole steam generation tool.

15. The method of claim 14, wherein the fluid body with rotational kinetic characteristics is provided downhole within the wellbore.

16. The method of claim 14, wherein the rotational kinetic characteristics of the fluid body are changed while the fluid body is within the wellbore.

17. The method of claim 14, wherein the passing of an electrical current through the fluid body to heat the fluid body takes place within the wellbore.

18. The method of claim 14, wherein the rotational kinetic characteristics of the fluid body promote separation of a vapor portion of the fluid body from a liquid portion of the fluid body.

19. The method of claim 14, wherein the fluid body is passed through a hydrocyclone to affect a rotational kinetic characteristic of the fluid body prior to passing the electrical current through the fluid body to heat the fluid body.

20. The method of servicing a wellbore of claim 14, wherein the vapor comprises steam, the method further comprising:

placing the downhole steam generation tool into the wellbore; and delivering steam to a subterranean formation penetrated by the wellbore.

* * * * *